US005624186A

United States Patent [19]

Ogier

[11] Patent Number: 5,624,186

[45] Date of Patent: Apr. 29, 1997

[54] MULTI-CHAMBER HIGH PRESSURE DISPERSION APPARATUS

[75] Inventor: Ray Ogier, Milton, Canada

[73] Assignee: Chem Financial, Inc., Canada

[21] Appl. No.: 597,692

[22] Filed: Feb. 6, 1996

[51] Int. Cl.[6] ..... B01F 15/02

[52] U.S. Cl. ..... 366/176.1; 366/182.2; 366/262

[58] Field of Search ..... 366/262, 263, 366/264, 270, 279, 3, 14, 15, 176.1, 176.2, 177.1, 178.1, 182.2

[56] References Cited

U.S. PATENT DOCUMENTS

| | | | |
|---|---|---|---|
| 3,679,182 | 7/1972 | Clocker | 366/263 |
| 3,941,355 | 3/1976 | Simpson . | |
| 3,942,765 | 3/1976 | Henrickson . | |
| 4,087,862 | 5/1978 | Tsien . | |
| 4,294,549 | 10/1981 | Thompson | 366/263 |
| 4,806,019 | 2/1989 | Lutwick et al. . | |
| 4,834,542 | 5/1989 | Sherwood | 366/263 |
| 4,850,704 | 7/1989 | Zimmerly | 366/264 |
| 4,944,602 | 7/1990 | Buschelberger . | |
| 4,989,988 | 2/1991 | Hutter et al. . | |

*Primary Examiner*—Robert W. Jenkins

*Attorney, Agent, or Firm*—Gifford, Krass, Groh, Sprinkle, Patmore, Anderson & Citkowski, P.C.

[57] ABSTRACT

A method and apparatus for mixing two or more materials which are difficult to mix. The dispersion apparatus has a cylindrical housing which is divided into an upper chamber and a lower chamber by a baffle. The materials to be mixed are forced under high pressure into the lower chamber which is divided into three pressure zones by kinetic baffles. A turbine blade imparts energy to the liquids which are kept from swirling by the kinetic baffles. The high pressure of the materials introduced into the chamber forces the materials through an opening between the baffle and shaft turning the blade into the upper chamber. In the upper chamber a second blade imparts centrifugal force to the materials to force them outwardly through a porous screen. The materials are sheared as they move through the screen and then are delivered to an outlet.

9 Claims, 2 Drawing Sheets

MULTI-CHAMBER HIGH PRESSURE DISPERSION APPARATUS

BACKGROUND OF THE INVENTION

I. Field of the Invention

This invention relates to a method and apparatus for mixing two or more materials which are difficult to mix. More particularly, this invention relates to a method and apparatus for dispersion utilizing both static and dynamic mixing.

II. Description of the Prior Art

It is known to mix materials and mediums normally considered difficult to intermix, for example, fatty acids and caustic solutions. The immiscible liquids are introduced into a chamber, and a rotor is used to impart energy to the liquids to produce a mixture. However, rotary mixers tend to create vacuum zones and are relatively inefficient in imparting energy to the liquids.

It is also known to use static mixers, such as disclosed in U.S. Pat. No. 3,942,765, wherein a motionless elongated mixing element is disposed within a tubular body to intercept and shear material being mixed. The mixing element has a plurality of triangular elements extending on either side of a common center line. The triangular elements are in an axially staggered relationship. The mixing element is placed in a fluid flow of two immiscible phases. The triangular elements intercept and "bend" two immiscible phases together as they pass through the tubular body. However, this device requires substantial space and is not particularly effective in mixing immiscible materials.

Accordingly, it is desirable to provide a device which effectively mixes immiscible materials which is economical and efficient in its application. It is, therefore, an object of the invention to provide a dispersion apparatus which efficiently imparts high energy to produce superior mixing results.

It is further an object of the invention to produce a dispersion apparatus which is easily disassembled for cleaning and use in food processing.

It is also an object of the invention to produce a method and apparatus for mixing and utilizing both static and dynamic mixing.

SUMMARY OF THE INVENTION

Disclosed is a two-stage dispersion apparatus having a cylindrical housing which is divided into an upper chamber and a lower chamber by a partition. An axially disposed shaft extension passes through the partition to turn one turbine blade in the lower chamber and a second turbine blade in the upper chamber. A distribution ring having a circumferential skirt is mounted to the end of the shaft extension and is axially aligned with a primary inlet formed in a bottom wall of the lower chamber. Fluid material or particulate matter is pumped under high pressure upwardly through the primary inlet and into the skirt of the distribution ring. The liquid is forced through a plurality of radial holes in the skirt to direct the first fluid radially outwardly into pressure zones formed between "L" shaped kinetic baffles mounted in the chamber. A secondary inlet is positioned between two of the baffles to introduce a second material into one of the pressure zones of the lower chamber. The turbine blade imparts energy to the materials. The high input pressure forces the materials upwardly into a small annular opening between the shaft extension and baffle plate into the upper chamber. The materials are then directed outwardly by the second blade through a porous screen and through an outlet for further processing.

BRIEF DESCRIPTION OF THE DRAWINGS

The invention will be described further by way of examples in which reference to the accompanying drawings in which.

DESCRIPTION OF THE PREFERRED EMBODIMENT

Figure 1:
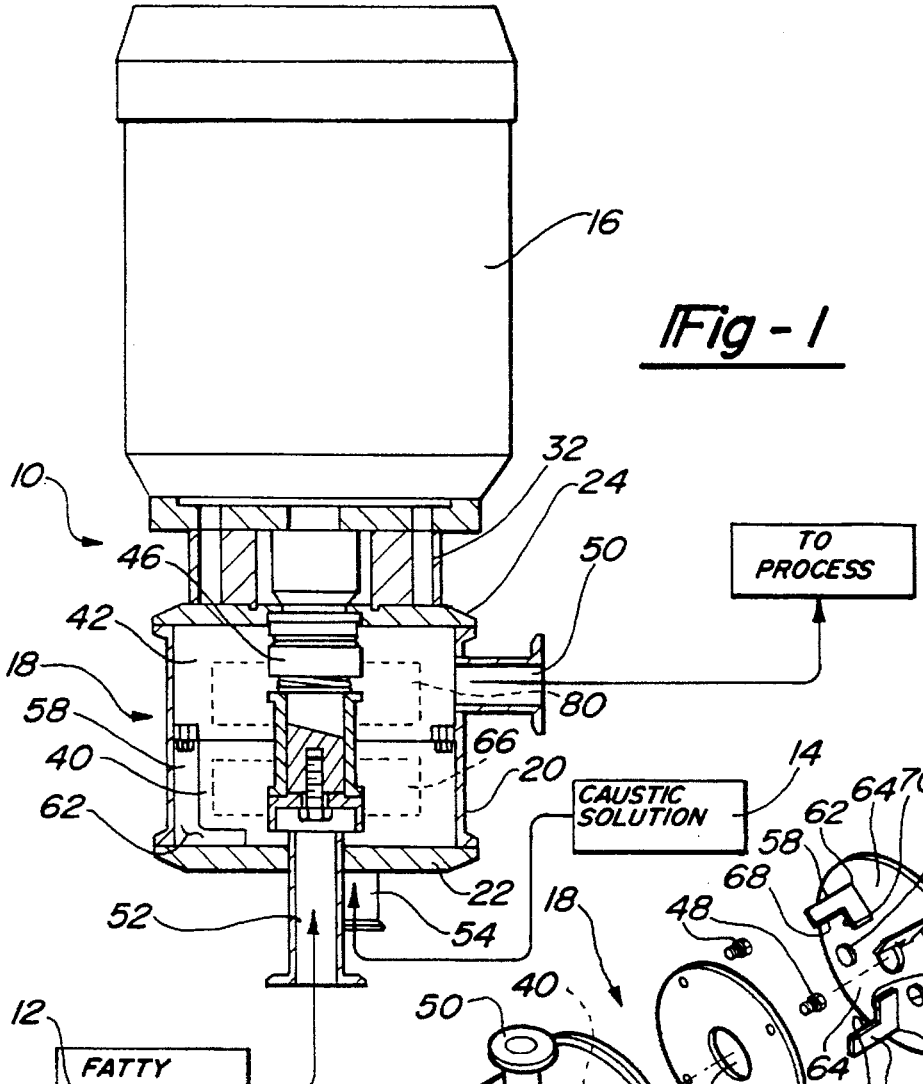
FIG. 1 is a sectional plan view of a dispersion apparatus in accordance with the invention.

Shown in FIG. 1 is a multi-stage dispersion apparatus 10 constructed in accordance with the present invention and suitable for mixing immiscible phases. Although shown here in conjunction with mixing fatty acids 12 and caustic solution 14, the dispersion apparatus 10 is suitable for use in a number of materials, particularly, fluids which are immiscible. The dispersion apparatus is easily disassembled for cleaning which results in being particularly useful in mixing foodstuffs for the food service industry.

As shown in FIG. 1, the dispersion apparatus 10 includes an electric motor 16 mounted above a two-stage mixing chamber 18. The electric motor 16 is mounted to a gland plate adapter 32 to support the motor 16 above the mixing chamber 18. The gland plate adapter 32 is satisfactory for mounting any C-face electric motor. The motor 16 turns a shaft 46 having a pair of blades as set forth below.

The mixing chamber 18 includes a cylindrical body 20 closed at a lower end by an inlet plate 22 and by a gland plate 24 enclosing an upper end.

Figure 2:
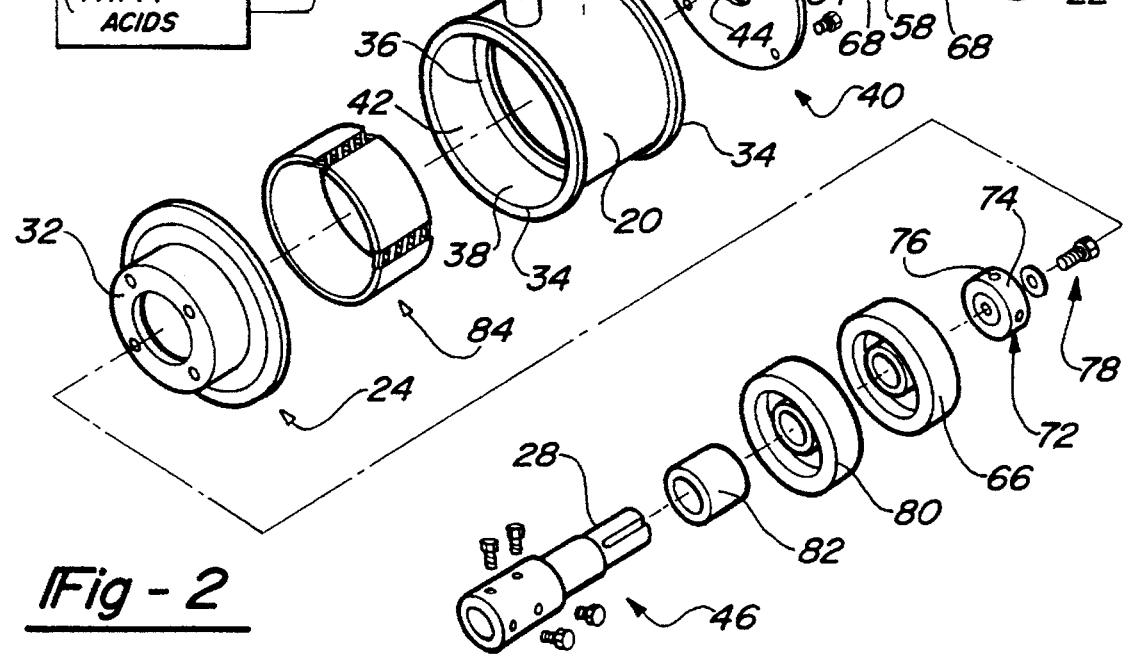
FIG. 2 is an exploded perspective view of a two-stage mixing chamber in accordance with the invention.

As shown in FIG. 2, the housing 20 is cylindrical, having a pair of end flanges 34 for attachment of the input plate 22 and gland plate 24. The plates are attached to the housing by fasteners such as sanitary clamps (not shown). A baffle support ring 36 is mounted to an interior wall 38 of the housing 20 midway between the flanges 34 for mounting of a baffle plate 40 to form a first stage lower chamber 40 adjacent the inlet plate 22 and a second stage upper chamber 42. The baffle plate 40 has a central aperture 44 for receiving the shaft 46. As will be discussed more fully below, an annular passage is formed between the center aperture 44 and the shaft 46. The clearance is quite small, approximately 1/16 inch. The baffle plate 40 is mounted by screws 48 or the like to the baffle support ring 36. An outlet 50 extends radially from the upper chamber 42 of the housing to deliver the material after it has been mixed for further processing or use.

Figure 4:
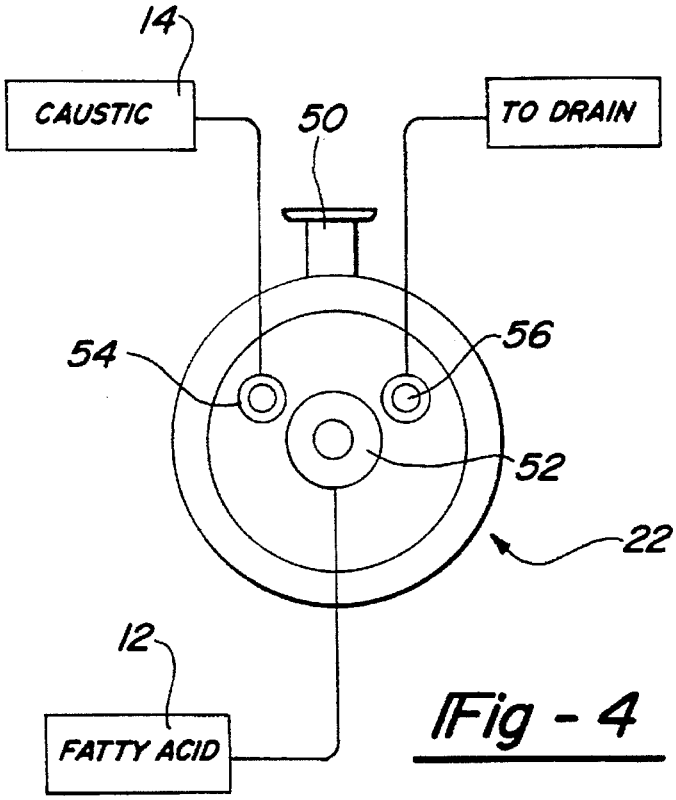
FIG. 4 is a plan view of the bottom of the two-stage mixing chamber in accordance with the invention.

As shown in FIGS. 2 and 4, the inlet cap 22 has a primary inlet port 52 aligned along the central axis for introducing a liquid, such as fatty acid 12, at high pressure upwardly into the lower chamber 40. A secondary inlet port 54 and a drain 56 are disposed radially outwardly from the primary port 52. The secondary inlet port 54 is connected to a supply of a second material, such as caustic solution 14, to be mixed with the first material from the primary inlet port 52. The drain 56 facilitates the emptying of the mixing chamber 18 prior to cleaning.

As shown in FIGS. 1 and 2, three L-shaped kinetic baffles 58 are mounted to the inside of the inlet plate 22 as shown in FIG. 2 to form three pressure zones 64. The L-shaped baffles 58 are disposed radially outwardly from the primary inlet port 52 with a long portion extending along the internal wall 38 of the housing 20. The baffles 58 are spaced approximately 120° apart and have interior edges 68, 70 extending at a right angle. A small aperture 62 is formed between the interior wall 38 of the housing and the long portion 60 of the baffles to permit a small amount of fluid to pass between adjacent pressure zones 64.

As shown in FIGS. 1 and 2, a turbine blade 66 is mounted in the lower chamber 40 on the shaft 46. The blade 66 is positioned to pass closely to interior edges 68, 70 of the baffles 58 so that there is a small distance between the blade 66 and the edges of the kinetic baffles 58. A distribution ring 72 is mounted to the distal end of the shaft extension 46. The ring 72 has a downwardly depending skirt 74 having lower apertures 76 extending radially through the skirt 74. The ring 72 is mounted to the shaft extension by a bolt 78.

A second turbine blade 80 is mounted within the upper chamber 42 of the housing. A spacer 82 is positioned on the shaft 46 between the turbine blade and a shoulder 28 on the shaft 46 to position a blade within the upper chamber 42. A porous screen 84 having a porosity of approximately ⅛ inch on 3/16 inch centers is positioned to extend between the gland plate 24 and the baffle plate 40 within the upper chamber. The screen 54 is cylindrical and has a diameter greater than the diameter of the blade 80, but less than the inner wall 36 of the housing 20 so that all material exiting the housing through the outlet 50 must pass through the screen 84.

Operation

Figure 3:
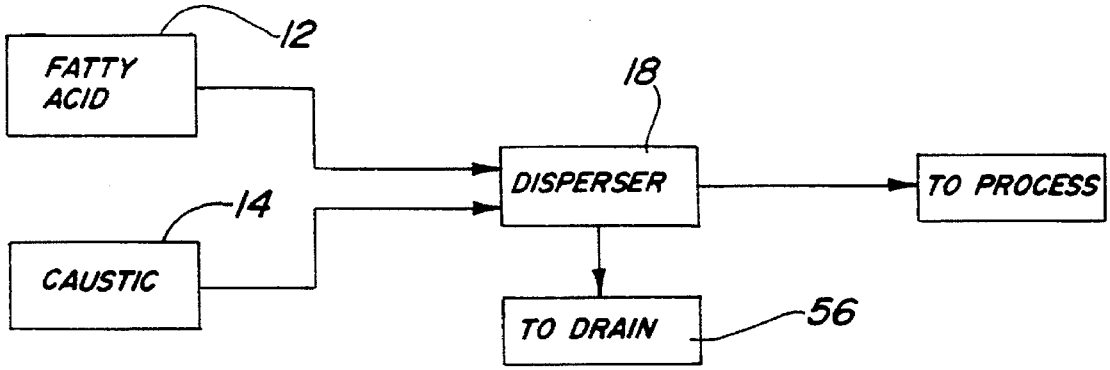
FIG. 3 is a flow chart showing the use of the dispersion apparatus in accordance with the invention.

As is discussed, the multi-stage dispersion apparatus 10 imparts high energy to the phases being mixed. The energy is formed both by dynamic and static mechanisms. As shown in FIG. 3, material, such as a fatty acid 12, is introduced through the primary input port 52 at high pressure, fix instance 150 lbs/inch, into the lower chamber 40. The material is received within the skirt 74 of the distribution ring 72 and is forced both under the input pressure and centrifugal force outwardly through the radial apertures 76 of the skirt 74 into the three pressure zones 64 formed between the kinetic baffles 58. The turbine blade 66 causes the material to rotate and to move outwardly in each of the three pressure zones 64.

The second material is introduced through the secondary inlet 54 in one pressure zone between the baffles. The baffles 58 prevent the two materials from merely being moved as a swirling mass around the turbine blade 66. A small amount of material is permitted to rotate from pressure zone to pressure zone 64 of the lower chamber by way of the apertures 62 in the baffles. Once directed outwardly by the turbine blade 66, the input pressure of the materials is such that it moves the combined materials upwardly through the aperture 44 in the baffle plate 40 and alongside of the shaft 46. Clearance between the shaft 46 and baffle plate 40 is such that the material is sheared as in the static mixing. The combined phase materials are then moved into the upper chamber 42 where the second blade 80 forces the material outwardly and through the fine porous screen 84. The rotation causes dynamic mixing and the screen 84 imparts energy by way of shear as the materials move through the screen 84. The porosity of the screen 84 may be controlled and coordinated with the nature of the materials being dispersed.

The multi-stage dispersion apparatus 10 is particularly suited for usages where it is necessary to clean the mixing chamber, such as in the food industry. The mixing chamber is disassembled and cleaned by removing the input plate 22 first, then the dispersion ring 72 and first turbine blade 66 are removed from the shaft 46. The baffle plate 40 is then removed by unscrewing it from the support ring 36 and the second turbine blade 80, spacer 82, and screen 84 are slid out. Finally, the shaft 46 may be removed as desired and the mixing chamber may be cleaned and sterilized.

While the particular preferred embodiment of the invention has been shown and described, the various modifications there suggested, it will be understood that the true spirit and scope of the invention as set forth in the appended claims, which embrace other modifications and embodiments which will occur to those of ordinary skill in the art. Although the apparatus is shown with two chambers, additional chambers could be formed by adding blades and baffle plates. Additionally, the chambers could be connected in series to mix in additional materials.

Having set forth the invention, what is claimed is:

1. A dispersion apparatus for mixing a plurality of materials, said apparatus comprising:
   - a housing having a bottom chamber and an upper chamber;
   - a motor mounted to said housing for turning a shaft extending into said housing;
   - a baffle plate mounted to said housing to separate said upper chamber from said lower chamber, said baffle plate having an aperture for receiving said shaft therethrough and forming an annular passage therebetween;
   - at least two kinetic baffles mounted within said lower chamber to form pressure zones;
   - an inlet cap mounted to said housing and having a primary inlet and a secondary inlet for delivering said plurality of materials into said lower chamber; and
   - a pair of blades mounted to said shaft, one of said blades disposed in said lower chamber and an other of said pair disposed in said upper chamber.

2. The dispersion apparatus of claim 1, further comprising a cylindrical screen disposed in said upper chamber to be spaced apart and to encircle said turbine blade.

3. The dispersion apparatus of claim 1, further comprising a dispersion ring mounted to an end of said shaft, said dispersion ring having a skirt having a plurality of apertures.

4. The dispersion apparatus of claim 3, wherein said primary inlet of said inlet plate is disposed in axial alignment with said shaft.

5. The dispersion apparatus of claim 1, wherein said kinetic baffles comprise L-shaped members disposed between said housing and said blade to form pressure zones.

6. The dispersion apparatus of claim 1, wherein said inlet cap is mounted for removal from said housing.

7. A method of mixing a plurality of materials comprising:
   - delivering a first material at high pressure through a primary inlet into a lower mixing chamber;
   - forming a plurality of pressure zones with baffles;
   - delivering a second material into one of said pressure zones;
   - rotating said first and second materials in said lower chamber;
   - shearing said materials in a passage between an upper and said lower chamber;
   - rotating said materials in said upper chamber; and
   - forcing said materials radially outwardly through a screen to shear said materials.

8. The method of claim 7, wherein said delivering steps further comprise delivering said first and second materials in an upward direction into said lower chamber.

9. The method of claim 7, further comprising a step of forcing said first material axially outwardly through a skirt of a dispersion ring into said lower mixing chamber.

* * * * *